US006414599B1

(12) United States Patent
Hsieh

(10) Patent No.: US 6,414,599 B1
(45) Date of Patent: Jul. 2, 2002

(54) SMOKE DETECTOR

(75) Inventor: Shih-Hsiung Hsieh, Pan-Chiao (TW)

(73) Assignee: Everday Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 09/777,173

(22) Filed: Feb. 12, 2001

(51) Int. Cl.[7] ..... G08B 21/10

(52) U.S. Cl. ..... 340/628; 340/538; 340/577; 340/584; 340/693.2

(58) Field of Search ..... 340/509, 577, 340/584, 628, 693.2, 517, 538

(56) References Cited

U.S. PATENT DOCUMENTS 4,138,670 A * 2/1979 Schneider et al. ..... 340/507
5,019,805 A * 5/1991 Curl et al. ..... 340/628
5,574,436 A * 11/1996 Sisselman et al. ..... 340/628
5,640,058 A * 6/1997 Calvo ..... 340/628
5,705,979 A * 1/1998 Fierro et al. ..... 340/517
5,973,603 A * 10/1999 Judy ..... 340/628
6,172,612 B1 * 1/2001 Odachowski ..... 340/628

* cited by examiner

*Primary Examiner*—Daniel J. Wu
(74) *Attorney, Agent, or Firm*—Rosenberg, Klein & Lee

(57) ABSTRACT

A smoke detector is adapted to be coupled to a fire monitoring unit, and includes a power consuming unit and a power supply unit. The power consuming unit is adapted to be coupled electrically to the fire monitoring unit so as to draw electric power therefrom. The power supply unit is coupled electrically to the power consuming unit, and is operable so as to supply electric power to the power consuming unit when the electric power from the fire monitoring unit is cut-off.

3 Claims, 1 Drawing Sheet

SMOKE DETECTOR

BACKGROUND OF THE INVENTION

1. Field of the Invention

The invention relates to a smoke detector for a fire monitoring unit, more particularly to a smoke detector which is adapted to be coupled to a fire monitoring unit and which has a power supply unit for providing electric power when electric power from the fire monitoring unit is cut-off.

2. Description of the Related Art

Since fire will result in severe danger and loss, it is required to install fire protection devices, such as smoke detectors, in buildings. Conventional smoke detectors are arranged in appropriate positions of a building, and are coupled to a centralized fire monitoring unit installed in the building, which provides electric power to the smoke detectors. In the event of a fire, when any one of the conventional smoke detectors is activated to generate an alarm signal, the position of the activated smoke detector can be obtained by the fire monitoring unit for fire fighting purposes. Moreover, the fire monitoring unit controls the other smoke detectors adjacent to the activated smoke detector to generate alarm signals for alerting people in the building.

However, when the fire monitoring unit experiences power outage or is out of order such that the fire monitoring unit in unable to provide electric power to the conventional smoke detectors coupled thereto, the conventional smoke detectors thus cannot work, thereby resulting in increased danger.

SUMMARY OF THE INVENTION

Therefore, the object of the present invention is to provide a smoke detector which is adapted to be coupled to a fire monitoring unit and which has a power supply unit for providing electric power when electric power from the fire monitoring unit is cut-off.

According to the present invention, a smoke detector is adapted to be coupled to a fire monitoring unit. The smoke detector includes a power consuming unit and a power supply unit.

The power consuming unit is adapted to be coupled electrically to the fire monitoring unit so as to draw electric power therefrom.

The power supply unit is coupled electrically to the power consuming unit. The power supply unit is operable so as to supply electric power to the power consuming unit when the electric power from the fire monitoring unit is cut-off.

BRIEF DESCRIPTION OF THE DRAWING

Other features and advantages of the present invention will become apparent in the following detailed description of the preferred embodiment with reference to the accompanying drawing, of which.

DETAILED DESCRIPTION OF THE PREFERRED EMBODIMENT

Figure 1:
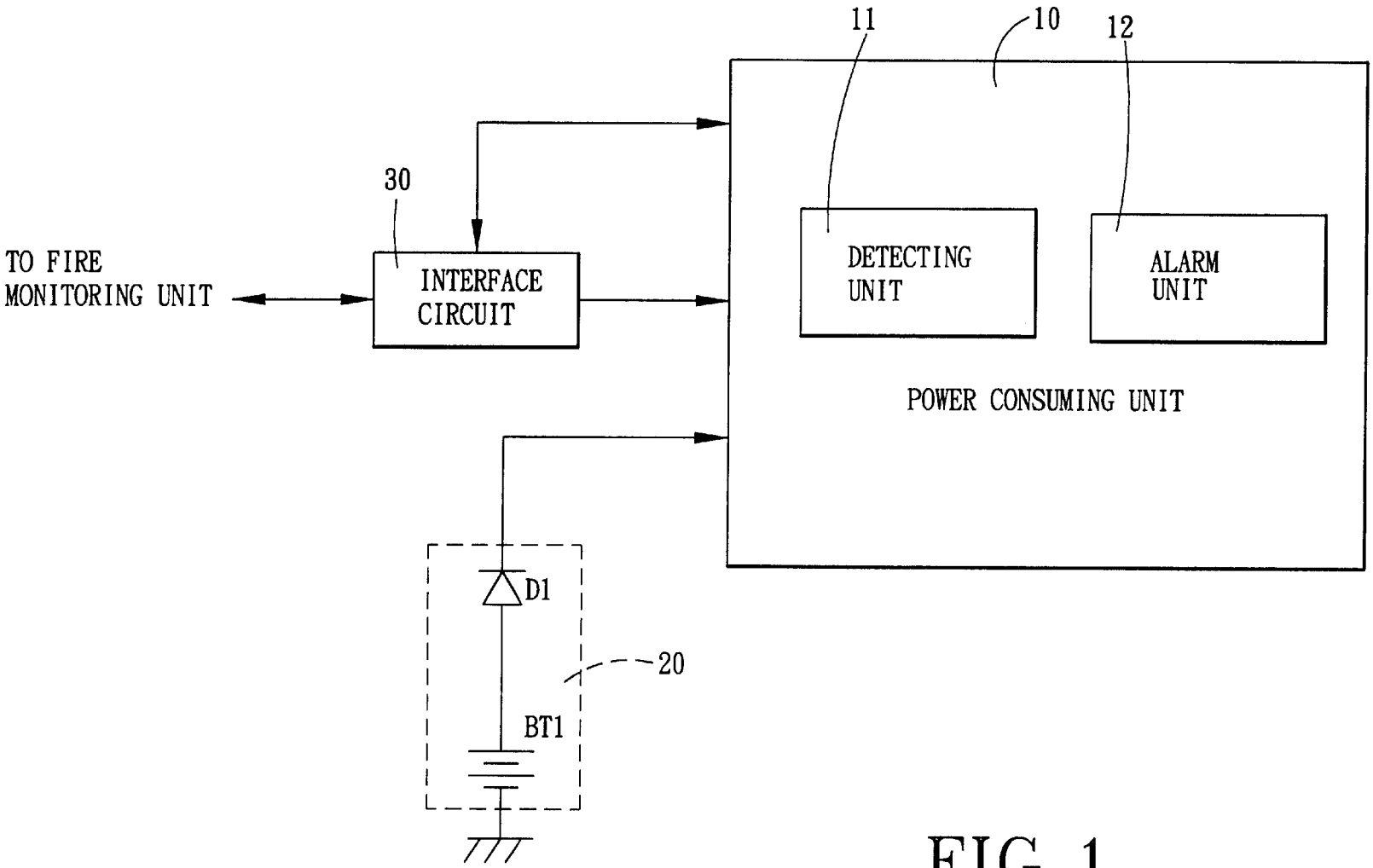
FIG. 1 is a schematic circuit block diagram illustrating the preferred embodiment of a smoke detector according to the present invention.

Referring to FIG. 1, according to the preferred embodiment of the present invention, a smoke detector is adapted to be coupled to a fire monitoring unit (not shown) and is shown to include a power consuming unit 10, a power supply unit 20, and an interface circuit 30.

The power consuming unit 10 is adapted to be coupled electrically to the fire monitoring unit via the interface circuit 30 so as to draw electric power therefrom. The power consuming unit 10 includes a known detecting unit 11 and a known alarm unit 12. When the detecting unit 11 detects the presence of products of combustion, such as smoke from a fire, the detecting unit 11 generates a fire signal to the fire monitoring unit via the interface circuit 30, and to the alarm unit 12 such that the exact position of a fire can be determined by the fire monitoring unit and such that the alarm unit 12 generates an alarm signal for alerting people in the vicinity of the fire.

The power supply unit 20 is coupled electrically to the power consuming unit 10. The power supply unit 20 is operable so as to supply electric power to the power consuming unit 10 when the electric power from the fire monitoring unit is cut-off. The power supply unit 20 includes a battery set (BT1), and a switch connected between the power consuming unit 10 and the battery set (BT1). The switch is capable of switching automatically from an open state, wherein the fire monitoring unit provides the electric power to the power consuming unit 10, to a closed state, wherein the battery set (BT1) provides the electric power to the power consuming unit 10. The switch includes a diode (D1) that has a cathode connected to the power consuming unit 10, and an anode. The battery set (BT1) has a positive terminal connected to the anode of the diode (D1), and a grounded negative terminal. The battery set (BT1) may be a rechargeable battery set.

It is noted that, due to the presence of the power supply unit 20, the smoke detector of the present invention can work even when electric power from the fire monitoring unit is cut-off, thereby resulting in increased safety. Furthermore, the work current required by the smoke detector is very small (about tens of $\mu$A) when the smoke detector is in a standby state such that the service life of the battery set (BT1) can be over one year and such that frequent replacement of the battery set (BT1) is not necessary.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A smoke detector adapted to be coupled to a fire monitoring unit, said smoke detector comprising:

a power consuming unit including a fire detector unit and a fire alarm unit;

an interface circuit electrically interposed between said power consuming unit and said fire monitoring unit, wherein said interface circuit transfers electrical power to said power consuming unit from said fire monitoring unit and wherein said interface circuit transmits an electrical signal to said fire monitoring unit conveying a location of a fire upon receiving a signal indicating presence of said fire from said fire detector unit; and a power supply unit coupled electrically to said power consuming unit, wherein said power supply unit includes a battery set, and a switch connected between said power consuming unit and said battery set, said switch being capable of switching automatically from an open state, wherein the fire monitoring unit provides the electric power to said power consuming unit via said interface circuit, to a closed state, wherein said battery set provides the electric power to said power consuming unit.

2. The smoke detector of claim 1, wherein said switch includes a diode that has a cathode connected to said power consuming unit, and an anode.

3. The smoke detector of claim 2, wherein said switch battery set has a positive terminal connected to said anode of said diode, and a grounded negative terminal.

* * * * *